US006226386B1

(12) United States Patent
Akino

(10) Patent No.: US 6,226,386 B1
(45) Date of Patent: May 1, 2001

(54) MICROPHONE

(75) Inventor: Hiroshi Akino, Sagamihara (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 09/311,179

(22) Filed: May 13, 1999

(30) Foreign Application Priority Data

May 15, 1998 (JP) ..... 10-134103

(51) Int. Cl.[7] ..... H04R 25/00; H04R 11/04; H04R 3/00

(52) U.S. Cl. ..... 381/173; 381/114; 381/361; 381/355

(58) Field of Search ..... 381/111, 114, 381/122, 361, 368, 94.5, 355, 173, 71.13, 317

(56) References Cited

U.S. PATENT DOCUMENTS 3,995,124 * 11/1976 Gabr .
4,427,845 * 1/1984 Yoshida .
4,442,323 * 4/1984 Yoshida et al. .
4,546,950 * 10/1985 Cech ..... 248/610
4,646,873 * 3/1987 Bryson ..... 181/160
5,170,434 * 12/1992 Anderson .
5,251,264 * 10/1993 Tichy ..... 381/173
5,363,452 * 11/1994 Anderson .
5,638,454 * 6/1997 Jones et al. ..... 381/71.14
5,701,354 * 12/1997 Komoda et al. ..... 381/344

* cited by examiner

*Primary Examiner*—Forester W. Isen
*Assistant Examiner*—Brian Tyrone Pendleton
(74) *Attorney, Agent, or Firm*—Welsh & Katz, Ltd.

(57) ABSTRACT

In a microphone having oscillation-proofing means provided between a microphone casing and a transducer unit, and output means, the microphone includes oscillation-detecting means provided in the microphone case for outputting an oscillation-detecting signal therefrom, when a microphone casing vibrates; and noise suppressor means for attenuating noise component which is contained in an acoustic electric output signal from said transducer unit, when vibration is excited by the microphone casing, based on the oscillation-detecting output signal from said oscillation-detecting means, whereby non-noise component acoustic electric signal can be outputted from output means.

22 Claims, 5 Drawing Sheets

MICROPHONE

FIELD OF THE INVENTION

The present invention relates to a microphone having features of attenuation of vibration noise, and in more detail to a microphone capable of attenuating both noise components such as oscillation noises which produces tap-tap sounds in relatively low frequencies, when a microphone's user fingers the microphone such that his fingers tap the microphone, and which produces rustling sounds in relatively high frequencies, when the user grasps the microphone.

BACKGROUND OF THE INVENTION

In a microphone in which acoustic energy from a sound source is converted into electric output through an oscillating element which oscillates in response to the acoustic energy transmitted thereto, there are two types of microphones which are mainly classified into a condenser microphone in which electric output is obtained on the basis of the relative displacement of an oscillator and an stator, and a dynamic microphone which electric output is obtained on the basis of the relative speed of an oscillator and an stator.

The relative displacement or speed of the oscillator and the stator is often affected by the vibration of the microphone. For the reason, there is a problem of the noise component contained in an normal converted electric signal from the acoustic energy. This is because that when a microphone casing of the microphone is displaced in one direction, the oscillator tends to sustain the mass at the first position. Therefore, noise component is generated.

Since the microphone is most used graspingly in the user's hand, the microphone case is susceptible to the occurrence of the vibration. Particularly to the dynamic microphone, a magnetic circuit is fixed to the microphone case, while a diaphragm is vibratingly supported on the microphone case. Therefore the dynamic microphone is susceptible to larger displacement of the diaphragm thereof relative to the magnetic circuit, when the vibration of the microphone case is generated.

It is generally known that a noise signal at highest level is generated by a directional microphone, and a nondirectional microphone and an nondirectional condenser microphone follows in order of the attenuating effect of suppression mode which includes mass, resistant and elastic control.

In noise component in relatively high frequencies of the noise component produced by the vibration of the microphone casing, there is not a specific directivity, since such the noise component propagates in a stationary manner to a transducer unit through a path which passes to a diaphragm across the microphone casing and a elastic support member. However, in noise component in relatively low frequencies of the noise component produced by the vibration of the microphone casing, there is a cos θ directivity.

In conventional known methods for reducing such the noise component, there are proposed as follows:

- a method by which a vibration isolation is made by means of visco-elastic member such as rubber to be mounted on a microphone casing, which is so called shock mount method (e.g. Japanese Patent Laid-Open No. 197000/1989), and
- a method by which an oscillation-detecting unit for detecting only oscillation noise is provided in a microphone in addition to an transducer unit, in a manner that one output signal is modulated against other signal (e.g., U.S. Pat. No. 2,835,735).

The vibration isolation which the above-stated shock mount effects, depends on the resonance frequency and the sharpness of the resonance of the oscillation system Accordingly, it is expected that the use of the shock mount enables only the effect which reduces the noise component in the frequency band where is a frequency higher than a relational frequency against a resonance frequency. In order to permit an expansion in a frequency band where provides allowance for effective vibration isolation, it is considered that a resonance frequency is set at lower level.

However, when the resonance frequency is set at the lower level, the transducer unit undergoes constant displacement against the normal position due to vibration caused by a microphone casing, so that the transducer unit is suffered from the collision with the inner surface of the microphone casing and the generation of the larger vibration noise of the low frequency component.

In the method for modulating one signal against other signal, a transducer unit for absorbing sound wave and an oscillation-detecting unit having same conversion mode as the transducer unit are used, wherein some noise signal is allowed to decrease satisfactorily in a manner that an adjustment of the phase and level of the output signal between the transducer unit and the oscillation-detecting unit is given by substraction.

However, in order to provide for equal phase and level in the wide frequency band of the output signals from both the units, it is not only required to carefully adjust the frequencies in the extreme but also the adjustment is essentially too difficult. Accordingly, there are need for adequately placing a limit of a frequency band area where oscillation is allowed to decrease, and also using a shock mount which expects a decrease in oscillation in other frequencies.

Furthermore, the oscillation-detecting unit is provided in an enclosure which prevents a propagation of acoustic energy from a sound source. In the oscillation-detecting unit, the oscillation is detected in an enclosed space to cause the frequency to be increased to a level at which the diaphragm is allowed to resonate, whereby output signal level decreases.

In addition, the transducer unit is disposed in a free space, while the oscillation detector unit is disposed in an enclosed space. As a result, the transducer unit is provided under an environment different than one of the oscillation-detector unit. Therefore, the output signals from both of the units undergo variations in phase and level which are previously adjusted due to a rise in the temperature, whereby the adjustment of the phase and the level is not normally operated to cause an increase of noise component. For the reason, it is required to adjust both phases and levels of output signals from the transducer unit and the oscillation-detecting unit. However, the adjustment of phase and levels between the two output signals needs extremely difficult operation.

BRIEF SUMMARY OF THE INVENTION

A first object of the present invention is, in consideration to the above-described problems, to provide a microphone which includes a microphone casing having an acoustic inlet; a transducer unit including an oscillation element for converting acoustic output which transmits from external source thereinto through said acoustic inlet into an electric signal; a support member for elastically supporting the transducer unit in said tubular casing, and output means for outputting electric signal input from said transducer unit to the outside of the microphone, wherein the microphone further includes oscillation-detecting means for detecting unnecessary oscillation wave which transmits from said microphone casing thereinto to output an oscillation-detecting signal therefrom, and noise attenuation means for attenuating noise component contained in said electric signal, on the basis of the oscillation-detecting input signal from said oscillation-detecting means.

A second object of the present invention is to provide oscillation detecting means which comprises a shock sensor having piezo electric elements to make voltage to be applied, when oscillation is applied.

A third object of the present invention is to provide noise suppressing means for attenuating noise component contained in electric acoustic output signal from a transducer unit in dependence on an oscillation-detecting signal which is based on the voltage applied by the oscillation-detecting means, the noise suppressing means including an amplifier for amplifying the oscillation-detecting output signal from the oscillation detector means, a wave detector for detecting waves of said amplified oscillation-detecting signal to output wave detecting signal therefrom, a smoothing circuit for smoothing the detecting wave output signal from said wave detector to output smoothing signal, a comparator for outputting a driving signal, when the smoothed output signal from said smoothing circuit is over a reference level, an analog switch for making and braking a circuit, based on the driving output signal from said comparator, and attenuating means for attenuating noise component contained in the acoustic electric signal, based on the switching operation of said analog switch.

The noise suppressing means also can be operated by a high pass filter provided therein for attenuating the noise component of the low frequency band contained in the acoustic electric signal which is outputted from a transducer unit to an output terminal.

DESCRIPTION OF THE PREFFERED EMBODIMENTS

Figure 1:
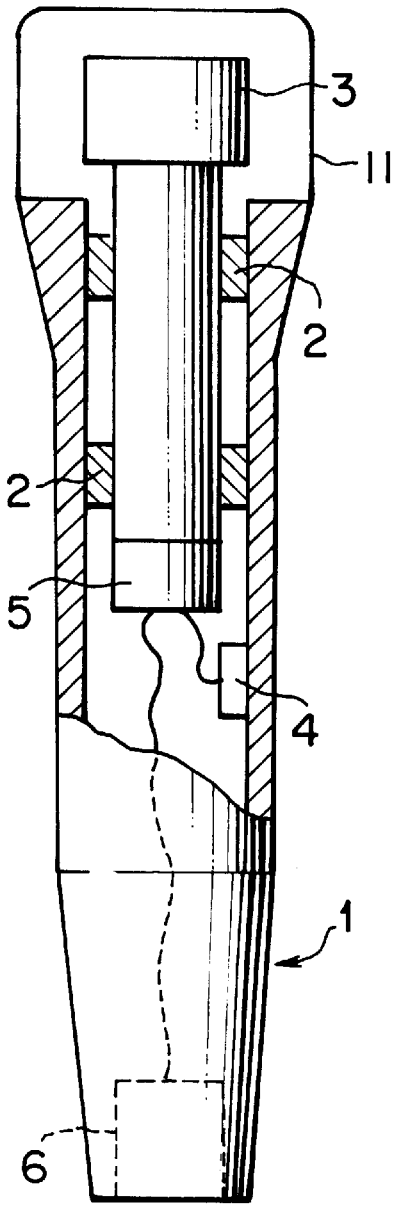
FIG. 1 is a partially sectioned schematic view showing a first and second embodiments of the present invention.

FIG. 1 is a partially sectioned schematic view showing a microphone of the present invention in which a composition of a dynamic microphone is shown.

The dynamic microphone has a microphone casing 1, a shock mount 2, a transducer unit 3, a shock sensor 4, noise suppressing means 5, and an output connector 6. The microphone casing 1 includes an window screen provided at the upper portion thereof as an acoustic inlet for covering the transducer unit 3. The microphone casing 1 further includes the output connector 6 disposed at the lower portion thereof. The output connector is connected to an external output audio cable to make the electric acoustic output signals to be outputted from the transducer unit 3 to an external acoustic apparatus.

The shock mount 2 comprises a ring-shaped elastic material having visco-elasticity. The transducer unit body 3 is inserted into and elastically supported by the ring which forms the shock mount 2 disposed at the upper and lower portions thereof. Furthermore, the inserted transducer unit 3 is fixedly press fit to the microphone through the shock mount 2, whereby suppresses the oscillation wave transmitted at high frequencies to the transducer unit 3 due to the vibration caused by the microphone casing. Therefore, the oscillation wave directly transmitting to the transducer unit 3 is eliminated, since the shock mount 2 covers the transducer unit 3.

Figure 2:
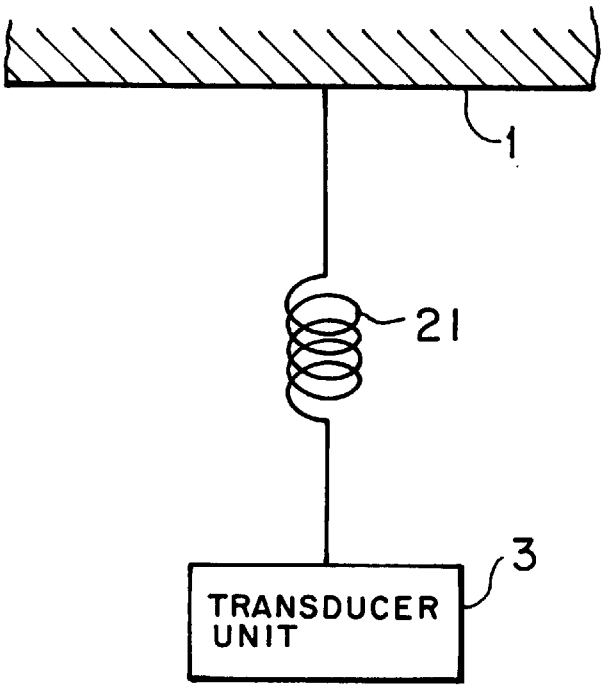
FIG. 2 is an explanatory view showing an operation of a shock sensor of the first and second embodiments.

As an example of the shock mount 2, as shown in FIG. 2, the shock mount 2 plays same part as a spring 21 to be suspended from a microphone casing 1 for supporting a transducer unit 3.

Moreover, the shock sensor 4 is directly mounted on the microphone casing 1, as shown in FIG. 1. Therefor, when the microphone casing 1 generates vibration, there is a difference in time between oscillatory waves transmitting from the microphone casing 1 to the transducer unit and the shock sensor 4. The issue will be given later again.

In the transducer unit 3, acoustic energy passing through a window screen from the external source is converted into an electric signal. After acoustic energy is converted into the electric signal, the electric signal is outputted from the transducer unit 3 to the output connector 6.

Furthermore, the shock sensor 4 for detecting vibration applied to the microphone casing 1 is disposed below the transducer unit 3. The shock sensor 4 outputs an oscillation-detecting signal, when the oscillation wave transmits thereto from the microphone casing 1, the shock sensor 4 being connected with the noise control means 5 disposed at the internal lower portion of the transducer unit through an electric line.

Figure 3A:
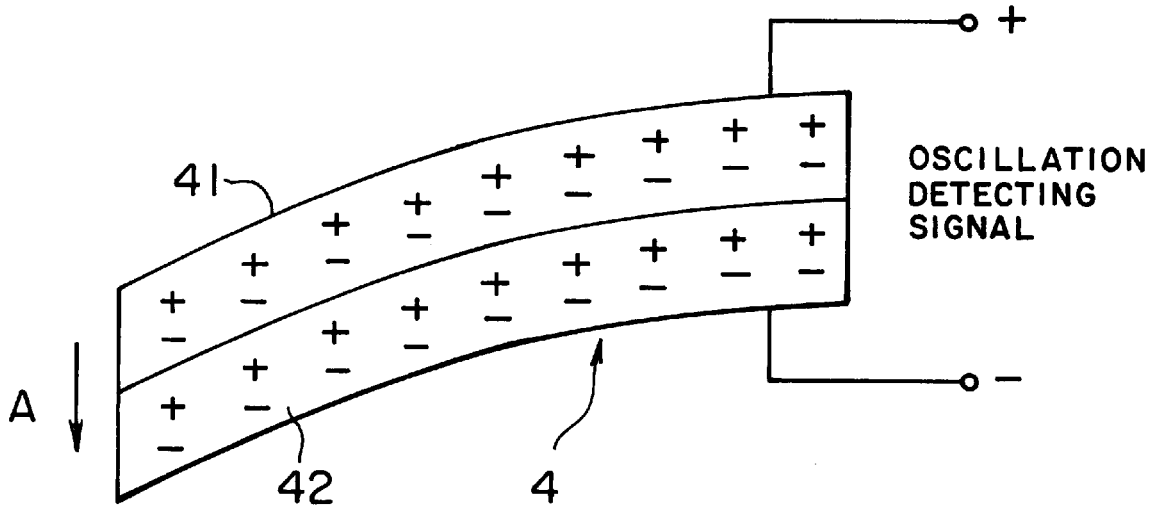
FIG. 3A is a explanatory view showing the shock sensor of the first and second embodiments.

The shock sensor 4 is directly mounted on the surface of the microphone casing 1, which includes, as shown in FIG. 3A, a pair of piezo electric elements 41 and 42. Therefor, when the oscillatory wave transmits from the microphone casing 1, the acceleration and force of the oscillation wave are applied in the A direction of the arrow, thereby one piezo electric element 41 is expanded, while other piezo electric element 42 is contracted.

Figure 3B:
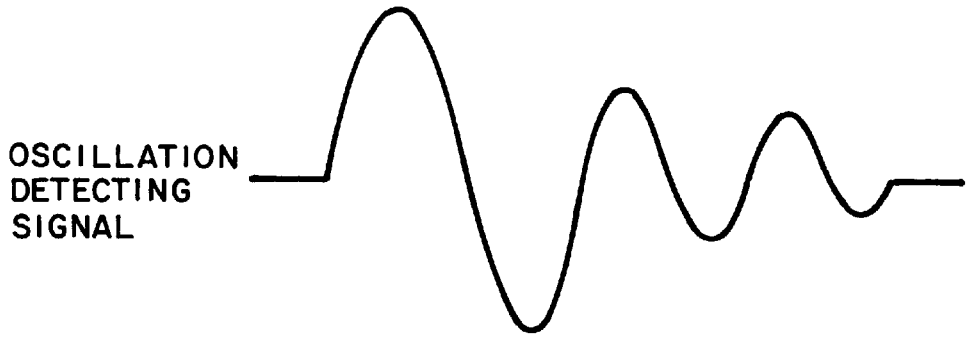
FIG. 3B is a waveform view of oscillation-detecting signal outputted from the shock sensor.

As a result, the electric charge is produced between the piezo electric elements 41 and 42 so that an oscillation-detecting signal based on the charge is generated. At that time, the oscillation detecting output signal from the shock sensor 4 forms same waveform as the oscillatory wave transmitting from the microphone casing 1 to the shock sensor 4, as shown in FIG. 3B.

The noise suppressing means 5 disposed at the internal lower portion of the transducer unit 3 includes an amplifier 51, a wave detector 52, a smoothing circuit 53, a comparator 54, an analog switch 55, and attenuating means 56.

The oscillation-detecting signal generated by the shock sensor 4 is outputted through the electric line into the noise suppressing means 5 provided in the transducer unit 3. The oscillation-detecting output signal from the shock sensor 4 amplifies through the amplifier 51 of the noise control means 5. The amplified oscillation-detecting signal is outputted from the amplifier to the wave detector 52 to be converted into a wave-detecting signal.

Figure 5A:
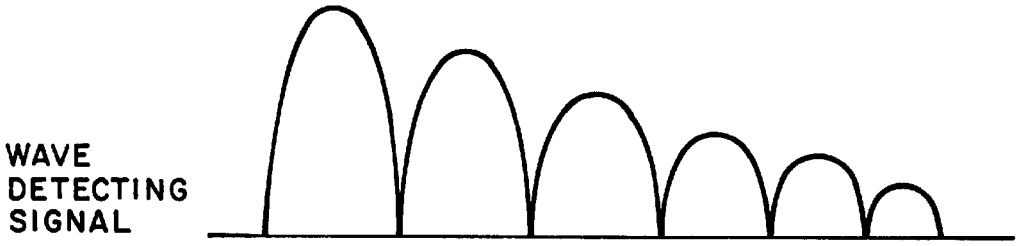
FIGS. 5A, 5B, and 5C are a waveform view of the oscillation-detecting signal converted into wave detecting signal by the noise suppressing means.

As shown in FIG. 5A, the converted oscillation-detecting signal from the amplification signal into the wave-detecting signal forms a periodic oscillatory wavelength to be outputted from the wave detector 52 in the shape of the rightward descent wavelength. Furthermore, the oscillation-detecting output signal from the wave detector is inputted into the smoothing circuit 53.

Figure 5B:
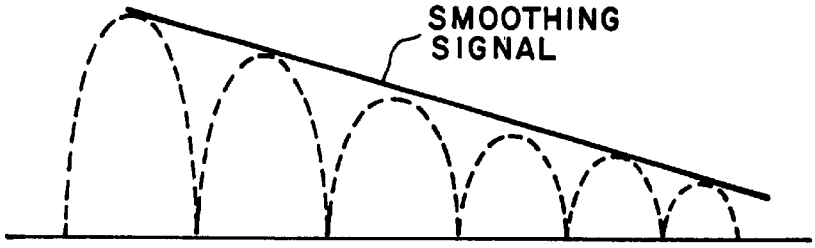

As shown in FIG. 5B, full line, the wave-detection input signal from the wave detector 52 into the smoothing circuit 53 is generated in the shape of the smoothing state. The generated smoothing signal in the smoothing circuit is outputted to the comparator 54.

Figure 5C:
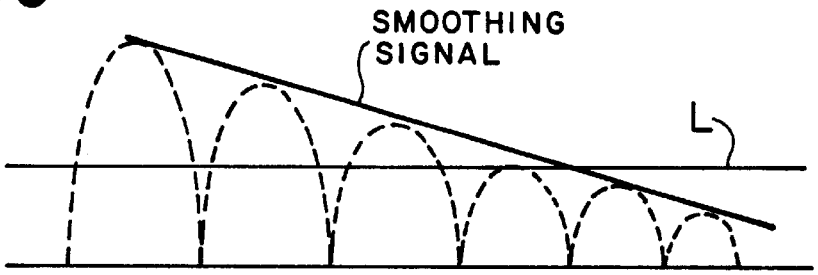

Furthermore, the converted smoothing signal from the oscillation-detecting signal is compared with a predetermined signal level by the comparator 54. As shown in FIG. 5C, if the comparator 54 detects the smoothing output signal from the smoothing circuit 53 at higher level than the predetermined reference signal input level L, the comparator 54 outputs the control signal to the analog switch 55. On the contrary, if the comparator 54 detects the smoothing output signal from the smoothing circuit 53 at lower level than the predetermined reference signal input level L, then the comparator 54 stops output of the control signal to the analog switch circuit. That is to say, in the comparator, the predetermined input signal level L is previously set so that the making of the analog switch connected with the comparator depends on the input level in the smoothing input signal from the smoothing circuit into the comparator 54.

As described above, the wave-detecting output signal from the wave-detector 52 forms a waveform whose shape descends rightward. This is because the oscillation-wave transmits from the microphone casing 1 to the shock sensor 4 to make the oscillating amplitude thereof to be gradually shortened as the time passed. In other words, the oscillation of the microphone casing 1 imparts actuation of the making to the analog switch 55. In accordance with a conception of the invention, the oscillation-detecting signal passing the amplifier 51 and the wave detector 52 is produced by the oscillatory wave caused by the vibration of the microphone casing 1. The oscillation-detecting output signal from the wave detector 52 through the amplifier 51 passes to the smoothing circuit 53 to be smoothed. The comparator 54 outputs the driving signal to the analog switch 55 during the time when the smoothed oscillation-detecting signal is inputted from the smoothing circuit 53 thereto at higher level than the reference input signal level L. However, after the time passed, when the oscillatory wave transmitting from the microphone case 1 is not elevated above the reference level L in the amplitude which affects the acoustic electric output signal from the transducer unit 3, the comparator 54 does not output the driving signal.

Again referring to FIG. 4, the driving output signal from the comparator 54 passes to the analog switch 55 to make the attenuating means 56 to be actuated, whereby the noise component of the acoustic electric output signal from the transducer unit 3 is attenuated. The analog switch 55 comprises a switch 55A, and junctions 55B and 55C, which of the junctions 55B and 55C are connected with the output terminals 6A and 6B of the output connector 6, respectively. According to the invention, when the comparator 54 outputs the driving signal to the analog switch 55, the switch 55A of the latter is made so that the connection between the junctions 55B and 55C is made to impart actuation to the attenuating means 56. Whereas, when the comparator 54 does not output the driving signal to the analog switch 55, the switch 55A of the analog switch 55 is not made to impart actuation to the attenuating means 56. Therefore, the attenuating means 56 connected with the analog switch 55 is controlled by the making and breaking of the analog switch 55 in response to the driving signal which the comparator 54 outputs.

There are provided resistors 56A, 56B, and 56C in the attenuating means 55. The resistors 56A, and 56B are connected between the output terminals 3A and 3B of the transducer unit 3 and the output terminals 6A and 6B of the output connector 6, respectively. The 56C resistor is connected across the outlet of the resistor 56A and the junction 55B of the analog switch 55 thorough the signal line 7A. Furthermore, as description already given with respect to the composition of the analog switch 55, an outlet of the resistor 56B is also connected with the junction 55C of the analog switch 55.

As the composition of the noise component suppressing means described above, according to the microphone of the present invention, the attenuating means 56 is resultantly inserted into the output terminals 3A and 3B of the transducer unit 3 and the output terminals 6A and 6B of the output connector 6 for attenuating the noise component contained in the acoustic electric output signal from said transducer unit 3. Because the noise component contained in the normal, acoustic electric output signal from the transducer unit 3 is attenuated through the attenuating means 56, and only non-noise component-containing acoustic electric signal is taken out to be outputted to the output terminals 6A and 6B of the output connector 6.

Next, the description on the operation of the first example is given. Acoustic energy transmitting from an external source such as vocal sound is sensed by a diaphragm. The sensed acoustic energy is converted into an electric signal as an acoustic output by the transducer unit 3. The acoustic output signal from the output terminals 3A and 3B of the transducer unit 3 passes through the resistor 56A and 56B to the output terminals 6A and 6B of the output connector 6.

At the time, as soon as oscillatory wave transmits from the microphone casing 1 to the shock sensor 4, the shock sensor 4 senses the oscillatory wave. Then, an oscillation-detecting signal is outputted from the shock sensor 4 to the amplifier 5 of the noise suppressing means by the oscillatory wave sensed by the shock sensor 4. In the noise suppressing means, the oscillation-detecting signal passes to the amplifier 51, the wave detector 52, and the smoothing circuit 53, whereby a driving output signal from the comparator 54 is generated. Therefore, the making of the switch 55A of the analog switch 55 is effected to make the attenuating means 56 comprised of the resistor 56A, 56B and 56C to be established.

According to the microphone of the present invention, oscillatory wave from the microphone casing 1 is restrained before transmitting to the transducer unit 3. As described above, the shock sensor 4 is provided in direct contact with the microphone casing 1. Therefore, the resultant difference in time is established between oscillatory wave transmitting from the microphone casing 1 to the transducer unit 3 and from the microphone casing 1 to the shock sensor 4.

Consequently, when the oscillatory wave reaches to the transducer unit 3, the attenuating means 56 of the noise suppressing means is already established on the signal lines 7A and 7B. Therefore, it makes certain of elimination of the component contained in the normal, acoustic electric output signal from the transducer unit 56. According to the present invention, as a result, non-noise component-containing normal, acoustic electric signal only passes to the output terminals 6A and 6B of the output connector.

Furthermore, as described above, the driving output signal from the comparator 54 is dependent on the waveform of the oscillatory wave transmitting from the microphone casing 1 to the shock sensor 4. In addition, as described in the above paragraph, there is a difference in time between the oscillatory wave transmitting to the transducer unit 3, and the shock sensor 4. As described above, the amplitude of the oscillatory wave passing the microphone casing 1 become dropped in accordance with the lapse of time. Therefore, if the microphone casing 1 does not generate new vibration after that the oscillatory wave passing the microphone casing 1 has been sensed by the shock sensor 4 to allow the noise signal to be attenuated by the attenuation means, the amplitude of the oscillatory wave transmitting from the microphone casing 1 to the shock sensor 4 decreases. If the comparator detects the smoothing signal at lower input level than the reference input level L, the attenuating means stops operation of the attenuation. Therefore, the normal, acoustic electric output signal from the transducer unit does not undergo variation due to the attenuation effected by the attenuating means 56.

Consequently, according to the microphone of the present invention, the noise component contained in the normal, acoustic electric output signal from the transducer unit 3 can be reduced. Furthermore, the output terminals 6A and 6B of the output connector 6 can output non-noise component-containing acoustic electric signal which provides increasing stability. Because, as described above, the attenuating means 56 for attenuating the noise component is actuated only at time when the comparator 54 detects the smoothing output signal from the smoothing circuit at higher input level than the reference input level L during that the oscillation detecting signal is inputted from the shock sensor 4 into the noise component suppressing means and transmitted to the comparator 54 through the amplifier 51, the wave detector 52 and the smoothing circuit 53.

Accordingly, noise component caused by which a microphone casing vibrates, can be eliminated from a normal, acoustic electric output signal from a transducer unit 3 without a difficult operation of level adjustment between both of the output signals from the transducer unit and the wave-detecting unit.

In addition, the above description of function of the noise control means was given as an example of a dynamic microphone, referring to FIG. 1. The composition of the transducer unit 3 may vary corresponding to features of the microphone.

For example, if the transducer unit 3 is used as a condenser microphone, the noise control unit comprises lower power-dissipating elements such as a C-MOS-IC so that excess power is resultantly not supplied to the transducer unit 3.

In the case of a dynamic microphone used for the transducer unit 3, the operation of the noise control means can be controlled by an ON/OF power switch.

Figure 4:
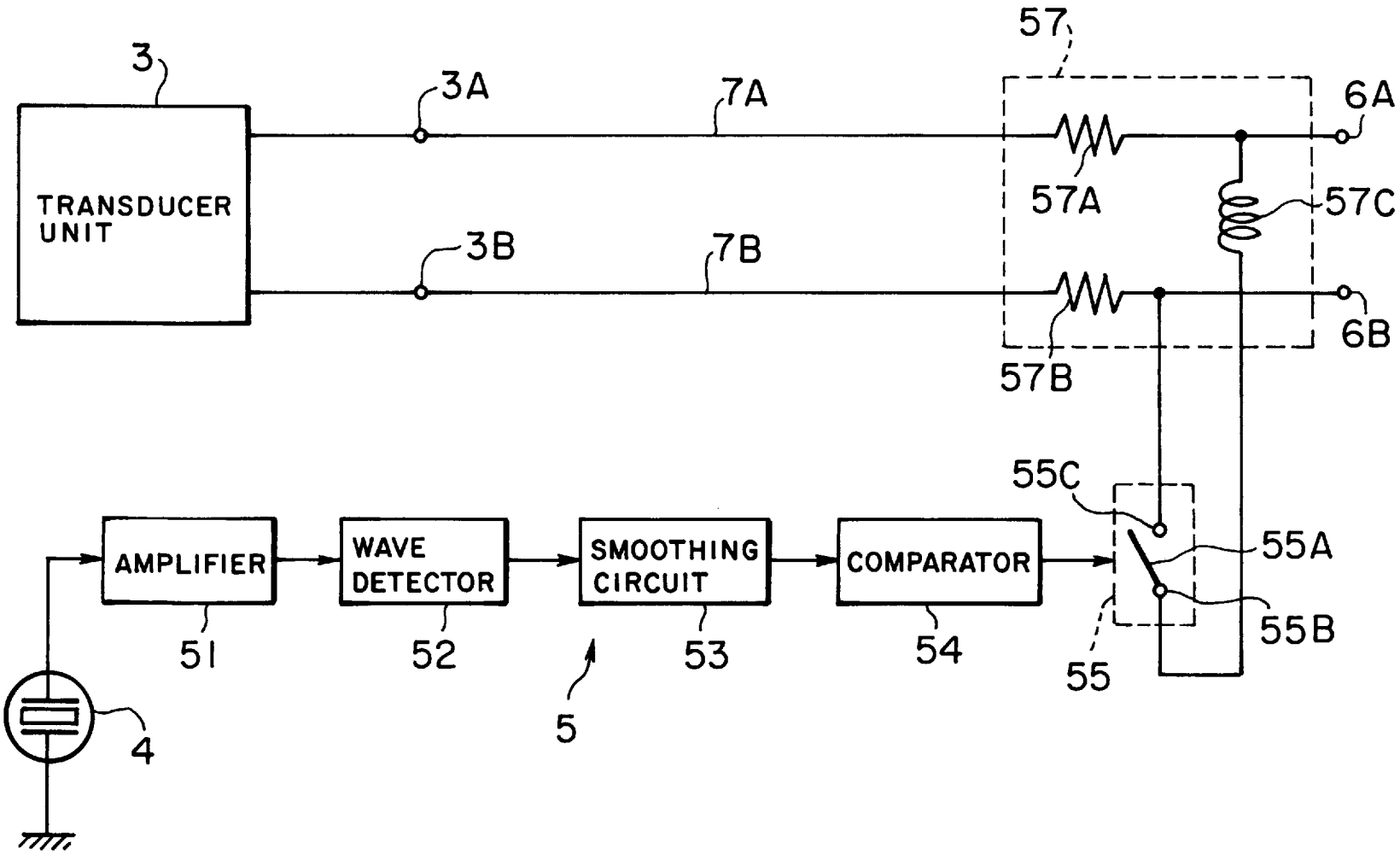
FIG. 4 is a block view showing noise suppressing means of the first embodiment.

Next, the description of a second embodiment will be given, referring to FIG. 6. According to the second example of the microphone of the present invention, the noise component caused by the vibration in lower frequency band can be eliminated, which can not be eliminated by the shock sensor 4. A comparison of FIG. 6 with FIG. 4 immediately indicates that there are different elements from FIG. 4, according to the composition of microphone of the present invention. The noise suppressing means of the microphone comprises a high pass filter having a coil 57*c* which replaces the resistor 56C. Accordingly, the description of the different parts in the second embodiment is only given. For this reason, in FIG. 6, same elements as one of the noise control means in FIG. 4 are designated by similar numerals.

Figure 6:
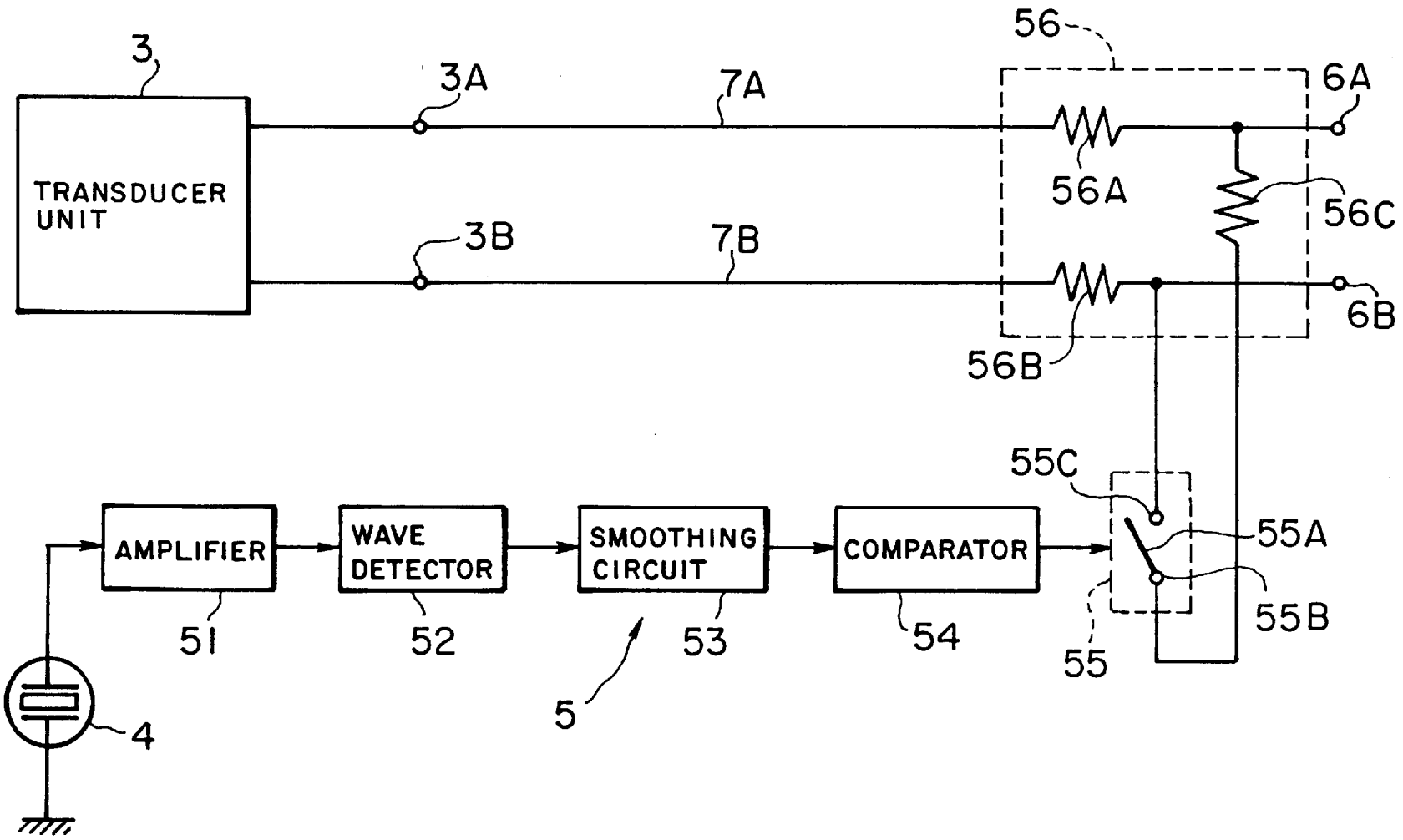
FIG. 6 is a block view showing noise suppressing means of the second embodiment of the present invention.

Referring to FIG. 6, attenuating means 57 includes a resistor 57A connected between an output terminal 3A of a transducer unit 3 and an output terminal 6A of an output connector 6 on a signal line 7A, a resistor 57B connected between an output terminal 3B of a transducer unit 3 and an output terminal 6B of an output connector 6 on a signal line 7B, and a coil 57C whose one end is connected between the resistor 57A and an output terminal 6A on the signal line 7B and other one is connected with a junction 55B of the analog switch 55. Thereby, a high pass filter is established between the output terminals 3A and 3B of the transducer unit 3, and the output terminals 6A and 6B of the output connector 6.

In the second embodiment of the microphone, the switch 55A of the analog switch 55 is made, whereby terminals of the coil 57C are connected between the resistor 57A and 57B and the output terminal 6A and 6B on the signal lines 7A and 7B, respectively.

In the attenuating means 57, although non-noise-containing component contained in an acoustic electric signal is outputted from the transducer unit 3, only noise component in lower frequencies is attenuated, while normal, acoustic electric signal is outputted to the output terminal 6A and 6B.

As described above, according to the second embodiment of the present invention, only the noise component in the lower frequencies is selectively attenuated. As this result, even if a vocal sound is uttered synchronously with the vibration caused by the microphone casing 1, only the noise components in the lower frequencies are attenuated so that the normal, acoustic electric signal converted from the acoustic energy of the sound source is only attenuated. Therefore, the microphone of the present invention avoids the problem in spacing loss of the vocal sound caused by which the normal acoustic energy is converted into the acoustic electric signal by the transducer unit 3 synchronously with the oscillatory wave by which the microphone casing 1 vibrates.

The descriptions of the first and second embodiments were fully given above. However, the present invention is not limited to embodiments described above. For example, when a microphone is mounted on a microphone stand which is disposed on a desk or a table, the shock sensor 4 and the noise control means 5 may be fixed on the microphone stand.

As described above, according to the present invention, the oscillatory wave caused by which the microphone casing 1 vibrates, transmits to the shock sensor 4 to allow the oscillatory wave to be sensed. The shock sensor 4 outputs the oscillation-detecting signal, based on the sensed oscillatory wave, while oscillatory wave transmitting to the transducer unit 3 is delayed through the shock mount 2. Thereby, when the oscillatory wave caused by which the microphone casing 1 vibrates, transmits to the transducer unit 3, the attenuating means 56 or 57 is already established between the output terminals 3A and 3B of the transducer unit 3, and the output terminals 6A and 6B of the output connector 6, in response to the driving output signal from the comparator 54. Therefore, the noise component contained in the normal, acoustic electric output signal that is generated from the oscillatory wave by which the microphone casing 1 vibrates, is eliminated.

Accordingly, the microphone of the present invention differs from conventional microphones in that there is no need for finely adjusting difference in level and phase between the output signals from the transducer unit and the oscillation-detecting unit. In addition, in the microphone of the present invention, the noise component produced by which the microphone casing 1 vibrates, can be attenuated by a simple composition of the oscillation-detecting means and the noise suppressing means. Therefore, there is no need for providing a complex construction for a circuit provided in the microphone casing.

What is claimed is:

1. A microphone provided with a tubular casing having a sound inlet; a transducer unit provided in said tubular casing for converting acoustic output which is transmitted form an external source through said acoustic inlet, the transducer unit including one or more oscillating elements; support means for elastically supporting the transducer unit; and output means for outputting electric signals transmitted from said transducer unit to outside, said microphone including:

oscillation-detecting means for detecting unnecessary oscillatory waves which are transmitted to said one or more oscillation elements; and noise control means for attenuating noise component contained in said electric signal which is output from said output means, base on an oscillation-detecting signal which is output from said oscillation-detecting means, said noise control means including an amplifier for amplifying the oscillation-detecting output signal from said oscillation-detecting signal therefrom;

a wave detector for wave-detecting the amplified oscillation-detecting input signal of the amplifier to output the wave-detecting input signal of the amplifier to output the wave-detecting signal therefrom;

a smoothing circuit for smoothing the wave-detecting output signal from said wave-detector to output the smoothed wave-detecting signal therefrom;

a computer for comparing the smoothed signal with a reference input level which is previously set, and outputting a driving signal therefrom, when said smoothing signal is input thereinto at higher level than the reference level;

a switch for making and breaking a circuit connected therewith;

attenuation means which is controlled by said switch means so as to attenuate the noise component contained in the electric output signal from said transducer unit, when the making of the switch is actuated.

2. A microphone according to claim 1, wherein said microphone is supported by a microphone stand, and said oscillation-detecting means and said noise control means are provided on the microphone stand.

3. A microphone according to any of claim 1, wherein said oscillation-detecting mans includes one or more piezoelectric elements.

4. Microphone according to claim 1, wherein the attenuating means of said noise control means comprises two resistors connected in parallel between the transducer unit and the output means, and another resistor connected to the two resistors in series.

5. A microphone according to claim 4, wherein the attenuating means of said noise control means comprises two resistors connected in parallel between the transducer unit and the output means, and a coil connected to the two resistors in series, and thereby forming a high pass.

6. A microphone having a transducer unit; a casing which encloses said transducer unit and has an acoustic inlet through which an acoustic energy passes to the transducer unit for transformation to an acoustic electric signal, which is output to an output device; at least one or more elastic holders between said transducer unit and said casing device; at least one or more elastic holders between said transducer unit and said casing so that the transducer unit is fixed in the casing; vibration detecting means on the casing means on the casing inside to detect oscillatory waves from vibrations of the casing through piezoelectric elements for output of vibration detecting signals; and noise limiting means in the transducer unit to attenuate noise components contained in the acoustic electric signals in response to detection by the detecting means at the vibration of the casing; said noise limiting means comprising:

an amplifier to amplify the output vibration detecting signal;

a wave detector in which the amplified vibration detecting signals through said amplifier are detected to be output;

a smoothing circuit through which the output vibration detecting signals from the wave detector are smoothed to be output;

a comparator which the smoothed vibration detecting signals from said smoothing circuit are compared with a previously set reference input level and output during the input at higher level than the reference signal level;

a switch device for effecting closing and opening of the circuit; and attenuating means to attenuate the noise components contained in the acoustic electric signals from said transducer unit in accordance with the opening and closing of the circuit by said switch device; whereby the acoustic electric signals are output to said output device.

7. The microphone as claimed in claim 6, wherein said attenuating device is arranged between an output terminal of said transducer unit and an output terminal of said output connector.

8. The microphone as claimed in claim 7, wherein said attenuating device comprises a pair of firs resistors arranged between said output terminal of said transducer unit and said output terminal of said output connector, respectively, and a second resistor arranged between said pair of first resistors.

9. The microphone as claimed in claim 7, wherein said attenuating device comprises a pair of first resistors arranged between output terminals of said transducer unit and output terminals of said output connector, respectively, and a coil arranged between said pair of first resistors, as a bypass filter.

10. The microphone as claimed in claim 6, wherein a time-lag between vibratory waves travelling to said transducer unit and said shock sensor exists, whereby said attenuating device provides attenuation of a noise component contained in the acoustic electric signal.

11. The microphone as claimed in claim 6, wherein the attenuating device opens the circuit at the instant at which input level of the smoothed signals is detected as a lower than said reference signal level.

12. The microphone as claimed in claim 6, wherein said noise limiter comprises a C-MOS-IC for elimination of electric oversupply to the transducer unit.

13. The microphone as claimed in claim 6, wherein said noise limiter derives through an on/off switch of the microphone.

14. The microphone as claimed in claim 12, wherein said noise attenuating means provide selective attenuation of only the low frequency noise components.

15. A microphone having a transducer unit; a casing which encloses said transducer unit and has an acoustic inlet through which an acoustic energy passes to the transducer unit for transformation to the acoustic electric signals, the microphone being held by a microphone stand; at least one elastic vibration isolator in said casing or in said microphone stand for reduction in vibration of the microphone casing; vibration detecting means at said microphone stand to detect oscillatory waves from vibrations of the casing through piezoelectric elements; and noise limiting means at the microphone stand in the transducer unit to attenuate noise components contained in said acoustic electric signals at the vibration of the casing:

said noise limiting means comprising:

an amplifier to amplify the outputted vibration detecting signals;

a wave detector in which an amplified vibration detecting signal through said amplifier is detected to be output;

a smoothing circuit through which the output vibration detecting signals form the wave detector are smoothed to be output;

a comparator which the smoothed vibration detecting signals from said smoothing circuit are compared with a previously set reference input level and output during input at a higher level than the reference signal level;

a switch device of reflecting close and open of circuit; and attenuating means to attenuate the nose components of the acoustic electric signals from said transducer unit in accordance with an opening and closing of said circuit by said switch device; whereby the acoustic electric signals are output to said output device.

16. The microphone as claimed in claim 15, wherein said attenuating device is arranged between output terminals of said transducer unit and output terminals of said output connector.

17. The microphone as claimed in claim 16, wherein said attenuating device comprises a pair of first resistors arranged between an output terminal of said transducer unit and an output terminal of said output connector, and a second resistor arranged between said pair of resistors.

18. The microphone as claimed in claim 16, wherein said attenuating device comprises a pair of first resistors arranged between an output terminal of said transducer unit and an output terminal of said output connector, and a coil arranged between said pair of first resistors, as a bypass filter.

19. The microphone as claimed in claim 15, wherein a time-lag between vibratory waves travelling to said transducer unit and said shock sensor exists, whereby said attenuating device provides attenuation of noise component contained in the acoustic electric signal.

20. The microphone as claimed in claim 15, wherein the attenuating device opens the circuit at the instant at which an input level of the smoothed signals is detected as lower than said reference signal level.

21. The microphone as claimed in claim 15, wherein said noise limiter comprises a C-MOS-IC for elimination of electricity oversupply to the transducer unit.

22. The microphone as claimed in claim 21, wherein said nose attenuating means provides selective attenuation of only the low frequency noise components.

* * * * *